United States Patent [19]

Mainka et al.

[11] 4,368,611

[45] Jan. 18, 1983

[54] APPARATUS FOR PRODUCING EFFECT YARN

[75] Inventors: Manfred Mainka, Günzach; Heinz Bleeck, Probstried; Gerhard Wehrmeister, Kempten; Milan Czapay, Betzigau, all of Fed. Rep. of Germany

[73] Assignee: Firma Saurer-Allma GmbH, Kempten, Fed. Rep. of Germany

[21] Appl. No.: 247,021

[22] Filed: Mar. 24, 1981

[30] Foreign Application Priority Data

Apr. 11, 1980 [DE] Fed. Rep. of Germany ... 8009985[U]

[51] Int. Cl.[3] ..... D02G 3/34; D01H 13/04; D01H 7/88

[52] U.S. Cl. ..... 57/6; 57/12; 57/18; 57/352

[58] Field of Search ..... 57/3-6, 57/9, 11, 12, 13, 17, 18, 206, 207, 225, 226, 352, 354

[56] References Cited

U.S. PATENT DOCUMENTS

| | | | |
|---|---|---|---|
| 2,156,244 | 4/1939 | Mahoney | 57/352 X |
| 2,226,977 | 12/1940 | Overbey | 57/352 |
| 2,332,395 | 10/1943 | Nutter et al. | 57/207 X |
| 3,445,994 | 5/1969 | Nalpas | 57/18 X |
| 3,928,957 | 12/1975 | Mitov et al. | 57/18 |

FOREIGN PATENT DOCUMENTS

| | | | |
|---|---|---|---|
| 249543 | 2/1964 | Australia | 57/12 |
| 2192568 | 7/1972 | France | 57/18 |
| 309707 | 4/1929 | United Kingdom | 57/12 |

*Primary Examiner*—Donald Watkins

*Attorney, Agent, or Firm*—Blanchard, Flynn, Thiel, Boutell & Tanis

[57] ABSTRACT

In an apparatus for producing effect yarn, at least one pair of feed rollers is provided for supplying a yarn component creating the effect, this pair of rollers consisting of a driven feed roller and a pressure roller forced against it. Moreover, the apparatus has at least one supply arrangement for a foundation thread, a hollow spindle carrying a bobbin of binding thread and having a twist limiter, and a pair of draw-off rolls. A deflecting pin extending substantially parallel to the axes of the rollers is provided at the exit of the pair of feed rollers in the wedge formed between the two rollers. This deflecting pin serves to guide the foundation thread which is led past the pair of feed rollers on the outside. This deflecting pin is arranged substantially in the plane of thread movement passing through the line of contact of the two rollers and through the yarn components combined and false-twisted downstream of the line of contact.

8 Claims, 3 Drawing Figures

APPARATUS FOR PRODUCING EFFECT YARN

The invention relates to an apparatus for producing effect or fancy yarn, comprising at least one pair of feed rollers for supplying a yarn component creating the effect, this pair of rollers consisting of a driven feed roller and a pressure roller forced against it, at least one supply arrangement for a foundation thread, a hollow spindle carrying a bobbin of binding thread and having a twist limiter, and a pair of draw-off rollers.

In a known apparatus of this kind for producing effect yarn (German Laid-open Pending Patent Application No. 24 39 732), the yarn component creating the effect and the foundation thread are passed jointly through the pair of feed rollers. By means of a separate brake each for the effect creating yarn component and the foundation thread, the result is achieved that the two yarn components run through the pair of feed rollers at different speeds. The feed or delivery speed for the yarn component creating the effect is greater as a rule and is determined by the speed of the feed rollers. The foundation thread is held back by stronger braking and its speed is determined substantially by the draw-off rollers. Since the feed rollers rotate at a speed which is greater than that of the foundation thread, a slip occurs between the latter and the feed rollers and leads to rapid wear of the surfaces of the pair of feed rollers. Undesirable furrows form in the surface. Moreover, the result of the slip is abrasion of the foundation thread, which leads to fouling of the machine. Furthermore, the known apparatus allows only a limited number of effects to be produced. In addition, the uniformity of the effect yarn leaves something to be desired, in particular when the apparatus is put into operation after eliminating a fault. With the known apparatus, furthermore, it is not possible to produce flame effects or twist effects with an exact colour sequence. Due to the formation of furrows in the feed rollers, the transfer becomes uncontrollable, that is the difference in speed with which the yarn component creating the effect is fed to the foundation thread.

The problem underlying the invention is to provide an apparatus of the kind mentioned at the beginning for producing effect yarn which is of simple construction and easy to operate, in which wear of the pair of feed rollers is practically impossible and abrasion of the foundation thread is largely avoided and which moreover permits the production of a uniform effect yarn with a greater number of possibilities of variation.

According to the invention, this is achieved in that a deflecting pin for the foundation thread led past the pair of feed rollers on the outside and which extends substantially parallel to the axes of the rollers is provided at the exit of the pair of feed rollers in the wedge formed between the two rollers, the deflecting pin being arranged substantially in the plane of thread movement passing through the line of contact of the two rollers and through the yarn components combined and false-twisted to the rear of the line of contact.

The arrangement of this deflecting pin provided at the exit of the pair of feed rollers, suitably at the smallest possible distance from the line of contact of the rollers, makes it possible to lead the foundation thread or threads past the pair of feed rollers for the effect yarn component on the outside thereof. Thus, the foundation thread or threads no longer touches or touch the pair of feed rollers delivering the effect yarn component and wear of this pair of rollers and also at the same time abrasion of the foundation thread and fouling of the machine associated therewith are avoided. Steadying of the movement of the thread to the rear of the pair of feed rollers is also achieved by means of the deflecting pin, which improves the uniformity of the effect yarn. Since the foundation thread or threads and the effect yarn component are delivered by separate feed mechanisms and are only brought together at the deflecting pin, a larger number of possibilities of variation of the effects produced is available. Moreover, the new apparatus is distinguished by extremely simple construction and ease of operation.

An advantageous development of the invention consists in that a comb-like thread guide with a plurality of guide pins arranged off-set at a distance from one another in the direction of the axes of the rollers is provided for a plurality of foundation threads ahead of the deflecting pin in the direction of thread movement. By means of this additional thread guide, the foundation threads are held apart as far as the deflecting pin. The mutual distance between the foundation threads can easily be varied under these conditions, according to which of the guide pins the foundation threads are passed around. By varying the mutual distance between the foundation threads, the effects produced can be varied and further possibilities of variation of the effects produced with the apparatus are thereby obtained.

Further advantageous developments of the invention will appear from the remaining sub-claims.

The invention is described in detail hereinafter with reference to two embodiments shown in the drawing.

Figure 1:
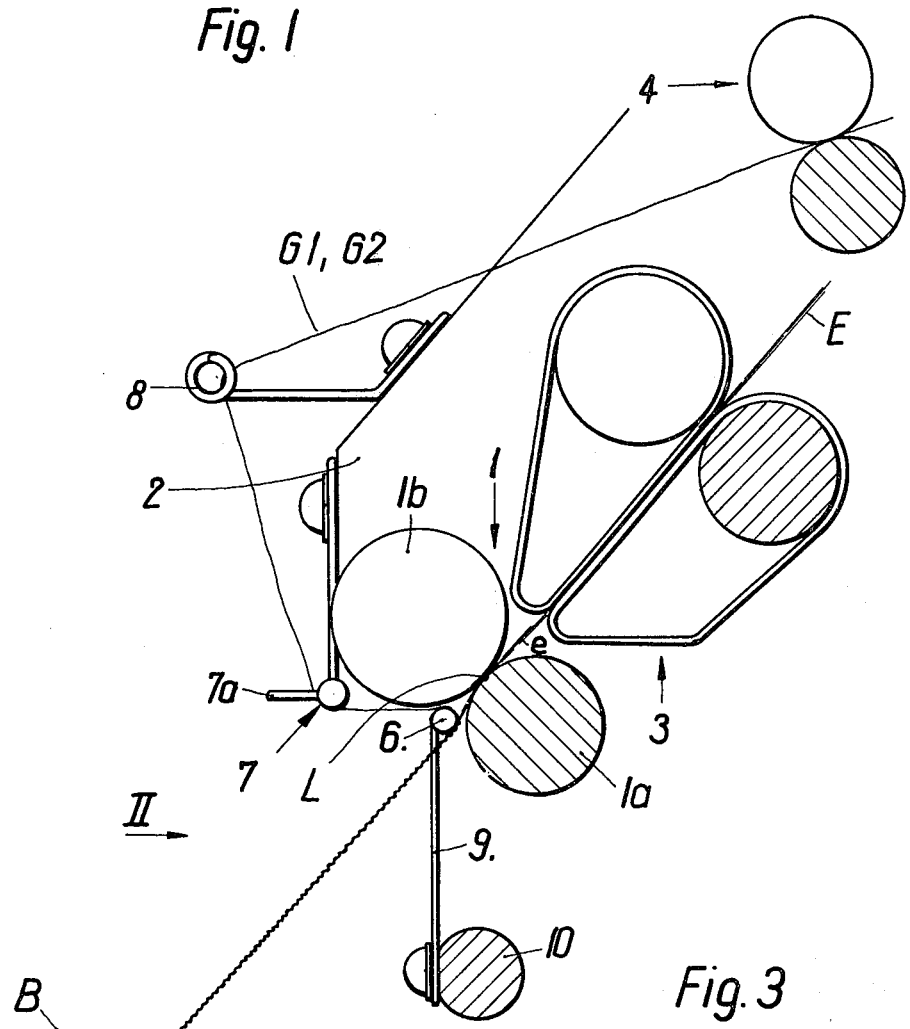
FIG. 1 is a side view of the apparatus.

In a machine for producing effect yarn there are mounted side by side a fairly large number of apparatuses according to the invention, one of which is described hereinafter in its construction and operation. In the first place, the apparatus has a pair of feed rollers 1 consisting of a continuous driven feed roller 1*a* and a comparatively short pressure roller 1*b* at each working station. This pressure roller is mounted in a pressure roller carrier 2 and is forced resiliently against the driven feed roller 1*a* through means known per se (not shown in detail). Since the effect yarn component E may consists of one or more rovings or slivers, a drawing mechanism 3 is moreover provided ahead of the pair of feed rollers 1 in the direction of thread movement. In addition, a separate feed mechanism 4 is provided for delivering one or more foundation threads G1, G2, this feed mechanism also again consisting of a continuous feed roller and a pressure roller. Mounted rotatably in the machine frame after the pair of feed rollers 1 in the direction of thread movement is a hollow spindle 5 carrying a bobbin (not shown) with a binding thread B. This binding thread bobbin rotates with the hollow spindle 5. At the lower end of the hollow spindle there is provided a twist limiter around which or through which the yarn components, E, B and G1 and/or G2 to be twisted together are led. Such twist limiters are also described as defining controllers. A twist limiter of this kind is disclosed, for example, in German Laid-open Pending Patent Application No. 20 53 385. Suitably, the axis of the hollow spindle 5 is arranged in the plane of thread movement *e—e*. By plane of thread movement there is understood that plane which passes through the line of contact L of the feed roller 1*a* and the pressure roller 1*b* and also, moreover, through the yarn components E and G1 and/or G2 combined and false-twisted after the line of contact L. A pair of draw-off rolls behind which the finished effect yarn is taken up is arranged behind the twist limiter in the direction of thread movement.

A deflecting pin 6 extending substantially parallel to the axes of the rollers is provided at the exit of the pair of feed rollers 1 in the wedge formed between the two rollers. This deflecting pin 6 serves to deliver the foundation threads G1 and G2 led around the feed mechanism 1 on the outside by means of more thread guides to the effect yarn component E. Since the effect yarn component may consist of an untwisted sliver of fibres, the point of bringing together must be located close to the feed point of this sliver in order to avoid breaking of the sliver. The deflecting pin 6 is therefore arranged suitably at the smallest possible distance from the line of contact L of the rollers 1*a* and 1*b* of the pair of feed rollers 1. Furthermore, it is also important that the movement of the fibres of the sliver is not impeded as far as possible. For this reason, the deflecting pin 6 is arranged substantially in the plane of thread movement *e—e* passing through the line of contact L of the two rollers 1*a* and 1*b* and through the yarn components E, G1, G2 combined and false-twisted after or behind the line of contact.

In particular when a plurality of foundation threads G1 and G2 are to be fed to the effect yarn component E, it is advantageous for a comb-like thread guide 7 with a plurality of guide pins 7*a* to be provided ahead of the deflecting pin 6 in the direction of thread movement. The guide pins 7*a* are arranged off-set at a distance from one another in the direction of the axes of the rollers. As can be seen in particular from FIG. 2, the two foundation threads G1 and G2 are passed between the guide pins 7*a*. According to which of the guide pins the foundation threads G1 and G2 are passed between, a more or less large triangle of threads is formed. The two foundation threads G1 and G2 combine with the effect yarn component E shortly after being deflected at the deflecting pin 6. By leading the foundation threads G1 and G2 optionally between two guide pins 7*a* arranged at a greater or smaller distance from one another, the creation of different effects can be achieved. Moreover, a spiral thread guide 8 serves to guide the foundation threads G1 and G2.

Figure 2:
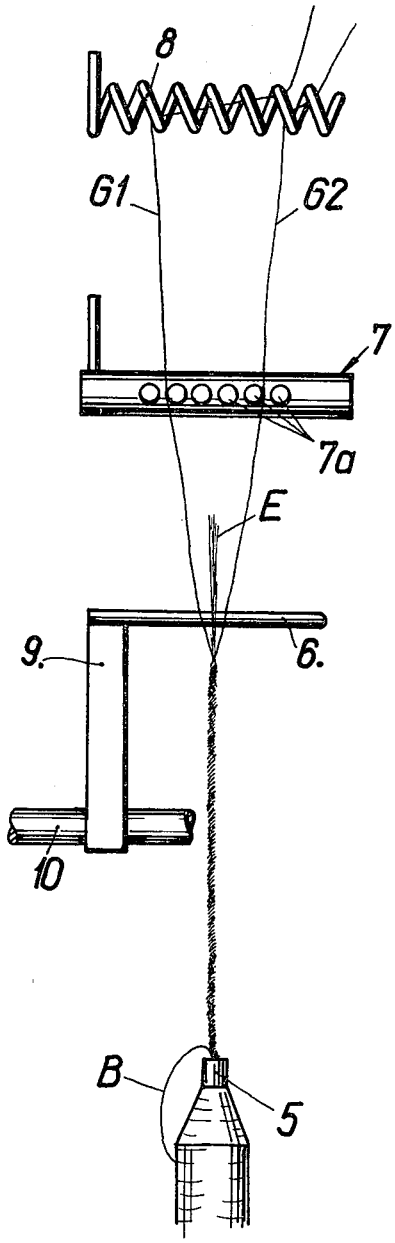
FIG. 2 is a view thereof in the direction II in FIG. 1.

As can be seen from FIGS. 1 and 2, the deflecting pin 6 is advantageously in the form of a round rod. In this way, the deflecting pin 6 is cheap to produce. One end of the deflecting pin is moreover advantageously fixed to a flat spring 9 which is connected in turn to a supporting bar 10. Due to the flat spring 9, the deflecting pin 6 can give way resiliently in the event of a ball or roll being formed on the feed roller 1*a* from the effect yarn component E.

Since the deflecting pin is in the form of a straight rod extending parallel to the axes of the rollers and which is moreover only mounted overhung at one end, the foundation threads G1 and G2 can very easily be placed over the deflecting pin 6 from the side.

Figure 3:
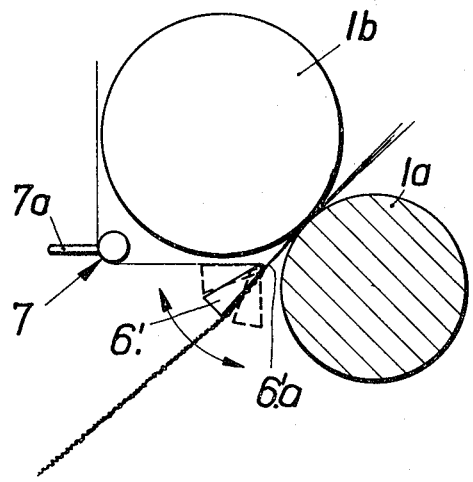
FIG. 3 shows a second embodiment in side elevation.

In the embodiment shown in FIG. 3, the deflecting pin 6' is of wedge-shaped cross-section. The form of the remaining structural parts is the same as that previously described. That edge 6'*a* of the deflecting pin 6' which is directed towards the line of contact L is rounded. Advantageously, the deflecting pin, as indicated by this part, may also be adapted to pivot about an axis arranged parallel to the axes of the rollers in the vicinity of the rounded edge 6'*a*. By bringing the deflecting pin 6' into different positions by pivoting it, the bearing area of the foundation threads G1 and G2 and of the effect yarn component E on the deflecting pin can be varied, whereby variation of the effects produced is also possible.

We claim:

1. In an apparatus for producing effect yarn which includes at least one pair of feed rollers for the yarn component which creates the effect, said pair of feed rollers consisting of a driven roller and a pressure roller forced against the driven roller, a supply arrangement for at least one foundation thread, a hollow spindle for carrying a bobbin of binding thread, said hollow spindle having a twist limiter, and a pair of draw-off rollers, the improvement which comprises a deflecting pin for the foundation thread arranged at the exit of the pair of feed rollers in the wedge between the feed rollers, said deflecting pin extending substantially parallel to the axes of the feed rollers and being arranged substantially in the plane of thread movement defined by the line of contact of said feed rollers and by the combined threads running to the hollow spindle downstream of the feed rollers, and means for guiding the foundation thread past the feed rollers on the outside thereof and then to the deflecting pin.

2. In an apparatus in accordance with claim 1 the further improvement wherein said foundation thread guiding means includes a comb-like thread guide for a plurality of foundation threads upstream of said deflecting pin, the thread guide having a plurality of guide pins spaced from one another in a direction parallel to the axes of the feed rollers.

3. Apparatus as claimed in claim 1 wherein the deflecting pin is arranged at the smallest possible distance from the line of contact of the feed rollers.

4. Apparatus as claimed in claim 1 wherein the deflecting pin is a round rod.

5. Apparatus as claimed in claim 1 wherein the deflecting pin has a wedge-shaped cross-section converging towards an edge adjacent the line of contact of the feed rollers, said edge being rounded.

6. Apparatus as claimed in claim 5 in which said deflecting pin is mounted for pivotal movement about an axis parallel to the axes of the feed rollers and close to said rounded edge.

7. Apparatus as claimed in claim 1 in which one end of said deflecting pin is connected by a leaf spring to a supporting rod.

8. Apparatus as claimed in claim 7 in which said supply arrangement for the foundation thread comprises a feed mechanism having an infinitely variable speed.

* * * * *